US009243485B2

(12) United States Patent
Kosakewich

(10) Patent No.: US 9,243,485 B2
(45) Date of Patent: Jan. 26, 2016

(54) SYSTEM AND METHOD TO INITIATE PERMEABILITY IN BORE HOLES WITHOUT PERFORATING TOOLS

(71) Applicant: Triple D Technologies Inc., Edmonton (CA)

(72) Inventor: Darrell S. Kosakewich, Camrose (CA)

(73) Assignee: Triple D Technologies, Inc., Edmonton (CA)

( * ) Notice: Subject to any disclaimer, the term of this patent is extended or adjusted under 35 U.S.C. 154(b) by 362 days.

(21) Appl. No.: 13/759,301

(22) Filed: Feb. 5, 2013

(65) Prior Publication Data

US 2014/0216728 A1 Aug. 7, 2014

(51) Int. Cl.
*E21B 43/26* (2006.01)

(52) U.S. Cl.
CPC ..... *E21B 43/26* (2013.01)

(58) Field of Classification Search
USPC ..... 166/302, 308.1, 57, 177.5, 177.1, 166/177.2, 268, 270, 270.1, 270.2, 400, 166/401, 402; 181/101–122, 401; 165/45; 62/260
See application file for complete search history.

(56) References Cited

U.S. PATENT DOCUMENTS

| | | | |
|---|---|---|---|
| 1,342,780 | A | 6/1920 | Vedder |
| 3,301,326 | A | 1/1967 | Mcnamer et al. |
| 3,424,662 | A | 1/1969 | Hudgins |
| 3,439,744 | A | 4/1969 | Bradley |
| 3,500,930 | A | 3/1970 | Bradley |
| 3,559,737 | A | 2/1971 | Ralstin |
| 3,602,310 | A | 8/1971 | Halbert |
| 3,720,065 | A | 3/1973 | Sherard |
| 3,759,329 | A | 9/1973 | Ross |
| 3,766,985 | A | 10/1973 | Willhite |
| 3,882,937 | A | 5/1975 | Robinson |
| 3,943,722 | A | 3/1976 | Ross |
| 3,978,921 | A | 9/1976 | Ross |
| 4,030,547 | A | 6/1977 | Ross |
| 4,124,253 | A | 11/1978 | Latiolais et al. |
| 4,424,858 | A | 1/1984 | Elliott et al. |
| 4,474,238 | A | 10/1984 | Gentry et al. |

(Continued)

FOREIGN PATENT DOCUMENTS

| | | | |
|---|---|---|---|
| CA | 2588297 | | 11/2007 |
| SU | 588289 | A1 | 1/1978 |
| WO | WO 2008/048451 | | 4/2008 |

OTHER PUBLICATIONS

International Search Report and Written Opinion for Application No. PCT/IB2013/000586, dated Oct. 16, 2013, 8 pp.

(Continued)

*Primary Examiner* — Sean Andrish
(74) *Attorney, Agent, or Firm* — Dawn-Marie Bey; Bey & Cotropia PLLC

(57) ABSTRACT

A shockwave generator pre-treats one or more production zones within a well to facilitate recovery of liquid and gaseous hydrocarbons from the well. The well may be heated to a particular temperature, where after a cooling agent is introduced through the shockwave generator which effects a cooling action in the walls of the well and induces cracking which is propagated by the tremors or shocks of the cooling agent as it exits the generator. The initiated cracks may be further propagated using one or more additional stimulation methods, including a freeze-thaw method which is implemented through a subsystem having overlapping components with the shockwave generator subsystem.

12 Claims, 5 Drawing Sheets

(56) References Cited

U.S. PATENT DOCUMENTS

| | | | |
|---|---|---|---|
| 5,097,903 | A | 3/1992 | Wilensky |
| 5,294,261 | A | 3/1994 | McDermott et al. |
| 5,507,149 | A | 4/1996 | Dash et al. |
| 5,653,287 | A | 8/1997 | Wilson et al. |
| 5,661,233 | A | 8/1997 | Spates et al. |
| 5,829,519 | A | 11/1998 | Uthe |
| 5,836,393 | A | 11/1998 | Johnson |
| 6,209,633 | B1 | 4/2001 | Haynes |
| 6,929,068 | B2 | 8/2005 | Chitty |
| 7,438,501 | B2 | 10/2008 | Sopko |
| 7,775,281 | B2 | 8/2010 | Kosakewich |
| 2005/0121396 | A1 | 6/2005 | Kosakewich |
| 2007/0095537 | A1 | 5/2007 | Vinegar |
| 2008/0035345 | A1 | 2/2008 | Kosakewich |
| 2009/0101348 | A1 | 4/2009 | Kaminsky |
| 2010/0263869 | A1 | 10/2010 | Kosakewich |
| 2010/0263874 | A1 | 10/2010 | Kosakewich |
| 2012/0067583 | A1* | 3/2012 | Zimmerman et al. ..... 166/308.1 |

OTHER PUBLICATIONS

Specifications and Claims for U.S. Appl. No. 13/762,931, filed Feb. 8, 2013.

International Search Report for PCT Application No. PCT/IB2013/000636, dated Sep. 24, 2013, 3 pp.

Written Opinion for PCT Application No. PCT/IB2013/000636, dated Sep. 24, 2013, 5 pp.

* cited by examiner

SYSTEM AND METHOD TO INITIATE PERMEABILITY IN BORE HOLES WITHOUT PERFORATING TOOLS

FIELD OF THE EMBODIMENTS

The embodiments relate in general to systems and methods for enhancing the efficiency of recovery of liquid and gaseous hydrocarbons from oil and gas wells. In particular, the embodiments relate to systems and methods for preparing a subsurface formation for and fracturing the subsurface formation to facilitate or improve the flow of hydrocarbon fluids from the formation into a well.

BACKGROUND OF THE EMBODIMENTS

A well drilled into a hydrocarbon-bearing subsurface formation, during an initial post-completion stage, commonly produces crude oil and/or natural gas without artificial stimulation, because pre-existing formation pressure is effective to force the crude, oil and/or natural gas out of the formation into the well bore, and up the production tubing of the well. However, the formation pressure will gradually dissipate as more hydrocarbons are produced, and will eventually become too low to force further hydrocarbons up the well. At this stage, the well must be stimulated by artificial means to induce additional production, or else the well must be capped off and abandoned. This is a particular problem in gas wells drilled into "tight" formations, i.e., where natural gas is present in subsurface materials having inherently low porosities, such as sandstone, limestone, shale, and coal seams (e.g., coal bed methane wells).

Despite the fact that very large quantities of hydrocarbons may still be present in the formation, it has in the past been common practice to abandon wells that will no longer produce hydrocarbons under natural pressure, where the value of stimulated production would not justify the cost of stimulation. In other cases, where stimulation was at least initially a viable option, wells have been stimulated for a period of time and later abandoned when continued stimulation became uneconomical, even though considerable hydrocarbon reserves remained in the formation. With recent dramatic increases in market prices for crude oil and natural gas, well stimulation has become viable in many situations where it would previously have been economically unsustainable.

There are numerous known techniques and processes for stimulating production in low-production wells or in "dead" wells that have ceased flowing naturally. One widely-used method is hydraulic fracturing (or "fraccing"). In this method, a fracturing fluid (or "frac, fluid") is injected under pressure into the subsurface formation. Frac fluids are specially-engineered fluids containing substantial quantities of proppants, which are very small, very hard, and preferably spherical particles. The proppants may be naturally formed (e.g., graded sand particles) or manufactured (e.g., ceramic materials; sintered bauxite). The frac fluid may be in a liquid form (often with a hydrocarbon base, such as diesel fuel), but may also be in gel form to enhance the fluids ability to hold proppants in a uniformly-dispersed suspension. Frac fluids commonly contain a variety of chemical additives to achieve desired characteristics.

The frac fluid is forced under pressure into cracks and fissures in the hydrocarbon-bearing formation, and the resulting hydraulic pressure induced within the formation materials widens existing cracks and fissures and also creates new ones. When the frac fluid pressure is relieved, the liquid or gel phase of the frac fluid flows out of the formation, but the proppants remain in the widened or newly-formed cracks and fissures, forming a filler material of comparatively high permeability that is strong enough to withstand geologic pressures so as to prop the cracks and fissures open. Once the frac fluid has drained away, liquid and/or gaseous hydrocarbons can migrate through the spaces between the proppant particles and into the well bore, from which they may be recovered using known techniques.

Another known well stimulation method is acidizing (also known as "acid fracturing"). In this method, an acid or acid blend is pumped into a subsurface formation as a means for cleaning but extraneous or deleterious materials from the fissures in the formation, thus enhancing the formation's permeability. Hydrochloric acid is perhaps most commonly as the base acid, although other acids including acetic, formic, or hydrofluoric acid may be used depending on the circumstances.

Another relatively new and more effective system and method for stimulating production in oil and gas wells is described in U.S. Pat. No. 7,775,281 entitled METHOD AND APPARATUS FOR STIMULATING PRODUCTION FROM OIL AND GAS WELLS BY FREEZE-THAW CYCLING and pending U.S. Patent Application Publication No. 2010/0263874 entitled METHOD AND APPARATUS FOR FREEZE-THAW WELL STIMULATION USING ORIFICED REFRIGERATION TUBING, both of which are incorporate herein by reference in their entireties. This new system and method fractures the subsurface formation by freezing a water-containing zone within the formation in the vicinity of a well, thereby generating expansive pressures which expand or created cracks and fissures in the formation. The frozen zone is then allowed to thaw. This freeze-thaw process causes rock particles in existing cracks and fissures to become dislodged and reoriented therewithin, and also causes new or additional rock particles to become disposed within both existing and newly formed cracks and fissures. The particles present in the cracks and fissures act as natural proppants to help keep the cracks and fissures open, thereby facilitating the flow of fluids from the formation into the well after the formation has thawed. Freeze-thaw fracturing enables recovery of higher percentages of non-naturally-flowing hydrocarbons from low-permeability formations than has been possible using previously known stimulation methods.

Prior to introducing a stimulation method, it is know to prepare the well by initiating cracks or instability in the well walls to better respond to the stimulation methods. This preparation has previously been accomplished using, a charge or other mechanical means, e.g., vibration hammer, to create a stress crack. These prior art preparation methods either include moving parts, which introduced inefficiencies into the process and/or they would damage wells having pre-existing slotted or perforated liners. Accordingly, there is a need in the art for an improved system and method for pre-treating a well bore in order to improve stimulation methods such as those discussed above.

SUMMARY OF THE EMBODIMENTS

In a first exemplary embodiment, a system for introducing fractures into one or more points on the sides of a well bore includes: a component having a length and width, wherein the width at its longest is less than a diameter of the well bore. The component further includes a first open end, a hollow core for receiving at least one of a liquid or gas therein via the first open end, a second closed end and a plurality of exit ports located along a periphery between the first open end and the second closed end of the component for facilitating exit of the at least one liquid or gas from the component into the well bore, wherein shockwaves are generated upon exit of the at least one liquid or gas from the component to cause fractures at one or more points on the sides of the well bore.

In a second exemplary embodiment, a method for introducing fractures at one or more points on the sides of the well bore includes: inserting a shockwave generation device into the well bore; pumping at least one of a cooling or heating agent into a first open end of the shockwave generation device and through exit ports along the periphery of the shockwave generation device to create shockwaves upon exit of the at least one cooling or heating agent from the component and a temperature differential of at least 50 degrees Celsius within the well bore; thereby introducing fractures at one or more points on the sides of the well bore.

In a third exemplary embodiment, a system for accessing hydrocarbons in a well bore includes: a first subsystem including a shockwave generator for introducing fractures at one or more points on the sides of the well bore; a second subsystem for expanding fractures introduced by the first subsystem using freeze-thaw fracturing and thereby releasing hydrocarbons; and a pressure valve for mechanically and functionally connecting the first subsystem to the second subsystem.

DETAILED DESCRIPTION

Figure 1:
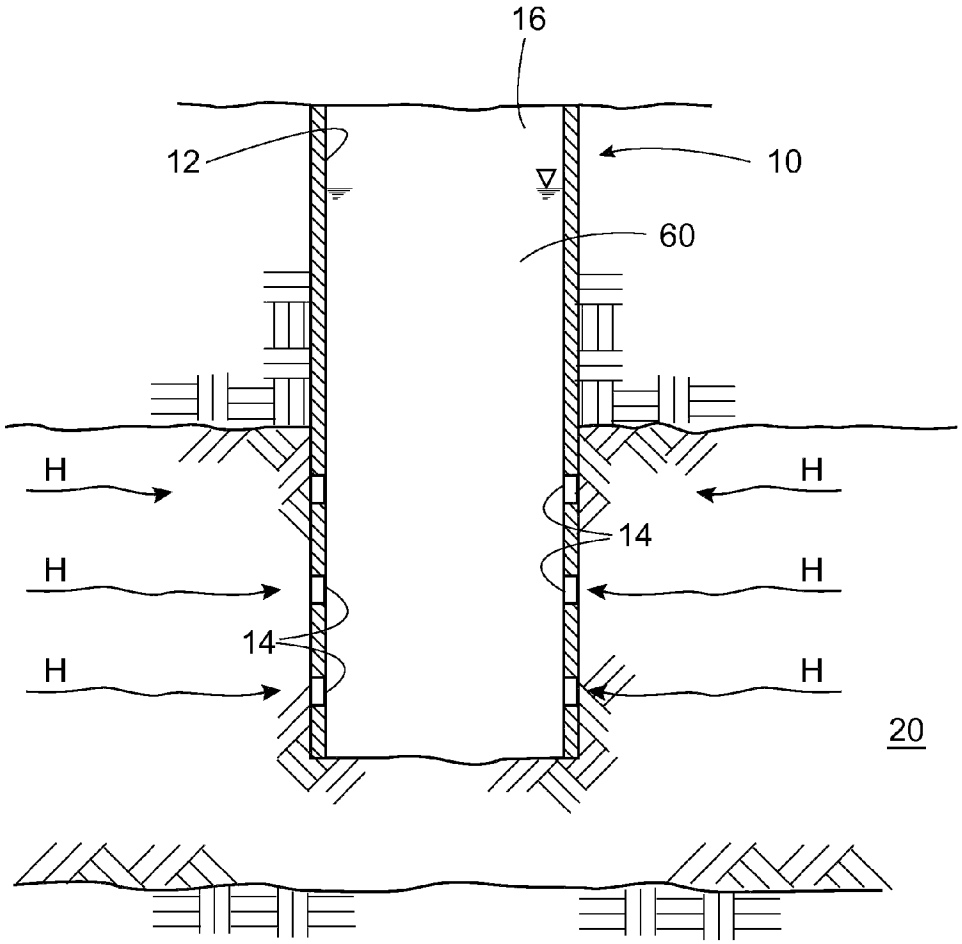
FIG. 1 PRIOR ART
FIG. 1 illustrates a well having a slotted liner as is known in the prior art.

Referring to FIG. 1, a representative prior art vertical well 10 drilled into a hydrocarbon-bearing subsurface formation 20 is shown. Well 10 will typically have a well liner 12, with perforations for slots) 14 in the production zone (i.e., the portion of well 10 that penetrates formation 20) to allow hydrocarbons H to flow from formation 20 into well 10. In some geologic formations it may be feasible to for well 10 to be unlined, such that hydrocarbons can flow directly into well 10. In either case, well 10 can be said to be exposed to formation 20, for purposes of this patent specification. When well 10 is producing, formation fluids comprising liquid and/or gaseous hydrocarbons are conveyed to the surface through a string of production tubing (not shown) which is disposed within well 10 down to the production zone.

Figure 2:
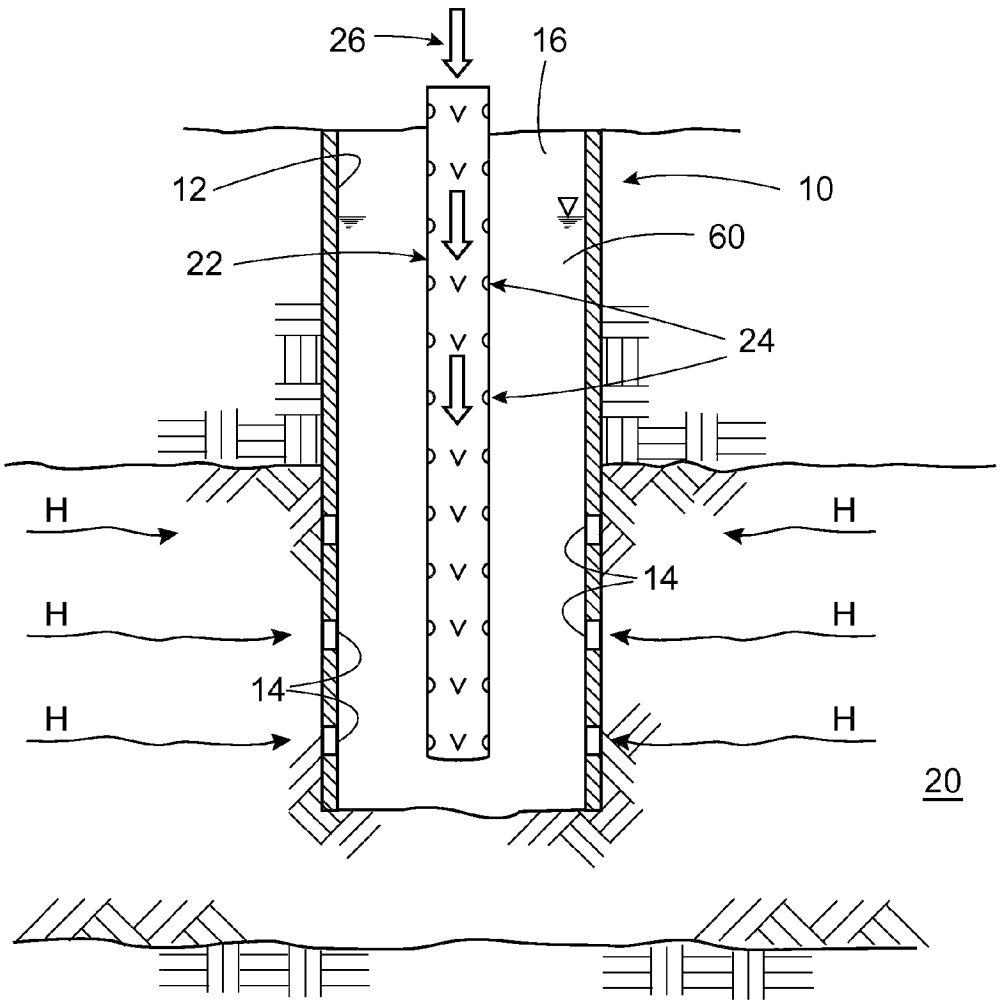
FIG. 2 illustrates a well having a slotted liner with a shockwave generator inserted therein in accordance with an embodiment described herein.

Referring to FIG. 2, a first embodiment of the present invention includes a shockwave generator 22 formed of, for example, copper, aluminum, brass, steel, hastelloy, or stainless steel materials. The generator 22 may be cylindrical, rectangular, square, triangular, hexagonal, polygonal in shape, so long as the largest width or diameter thereof as the case may be, is less than the inner diameter of the well bore (or liner, if lined). As described further below, the reverberations or reflections of shockwaves may enhance the initiation and propagation of fracturing. Accordingly, a generator having a shape with multiple mates, e.g., hexagonal, is expected to multiply this effect. The generator 22 includes a hollow core and has fluid or gas exit ports 24 spaced along the sides or circumference thereof.

The shockwave generator 22 is introduced into the well 10 of FIG. 1 using cranes or drilling rigs as known to those skilled in the art and, in accordance with the methods described herein below, pre-treats or pre-conditions one or more production zones within the well 10 in order to improve the efficiency of stimulation methodologies discussed in the Background of the Embodiments. Once the shockwave generator 22 is in place, heating and/or cooling agents 26, i.e., fluid, gas or combination thereof, are pumped through the shockwave generator 22 and through the exit ports 24 and into the well 10. This process results in a combination of thermal shock and shockwave generation whereby the well subsurface formation is subjected to stress from heat and extreme cold. More particularly, the leading shockwaves greatly enhance the ability of the heating and/or cooling agent(s) 26 to initiate and propagate cracks in the targeted rock surrounding the bore hole by generating sonic stresses that drive the rate of fracture. The subsurface formation may be, for example but not limited to, rock, mineral, hydrocarbon or coal. The heating and/or cooling agents 26 may be any singular or combination fluids and/or gases that result in a minimum temperature differential of 50 degrees Celsius. The greater the temperature differentials, the more rapid the propagation induction. By way of a non-limiting example, the well 10 may be heated to, for example approximately 150 degrees Celsius, using, e.g., by introducing steam or the like, and then a cooling agent 26 at approximately −50 degrees Celsius is introduced through the shockwave generator 22. The cooling agent 26 exiting the shockwave generator 22 effects a cooling action in the walls of the well 10 which induces cracking and the cracking is further propagated by the tremors or shocks of the cooling agent as it exits the generator 22.

While FIG. 2 illustrates a well 10 with a slotted liner, the shockwave generator 22 and the corresponding method for using may be used in wells that are open, slotted lined or lined with perforations. Exemplary heating and/or cooling agent(s) 26 include, but are not limited to, liquid nitrogen, liquid carbon dioxide, calcium chloride brine, or, preferably, liquid propane, steam, hot air, hot oil, chemically created exothermic reactions i.e., sodium hydroxide+$H_2O$, Calcium Oxide+$H_2O$, liquid hydrogen, liquid methane, ammonia, super cooled methanol and ethanol, helium, blast air, HFC's, and glycol/water.

Figure 3:
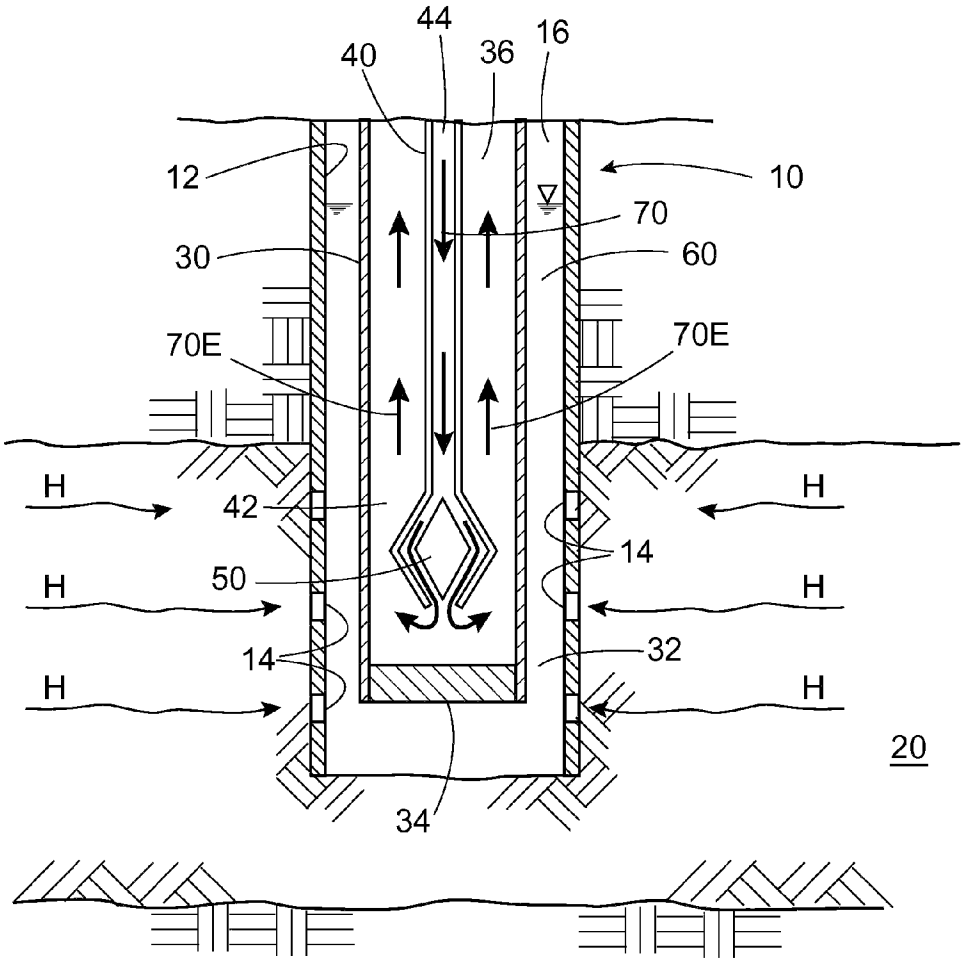
FIG. 3 PRIOR ART
FIG. 3 illustrates a well having a slotted liner with a freeze-thaw stimulation device therein in accordance with the description set forth in U.S. Pat. No. 7,775,281 and pending U.S. Patent Application Publication No. 2010/0263874.

FIG. 3 is a representative embodiment of a prior art freeze-thaw fracturing system and method as described in various embodiments of U.S. Pat. No. 7,775,281 and U.S. Patent Application Publication No. 2010/0263874 which are incorporated by reference herein. As described in those publications, a string of refrigerant return tubing 30 is inserted into well 10, creating a generally annular well annulus 16 surrounding return tubing 30. The lower end 32 of return tubing 30 is sealed off by suitable plug means 34; by way of non-limiting, example, plug means 34 may be in the form of a conventional packer disposed within the bore of return tubing 30 in accordance with known methods, or in the form of a permanent welded end closure. A string of refrigerant supply tub rig 40 extends within return tubing 30, creating a generally annular tubing annulus 36 surrounding supply tubing 40.

The lower end 42 of supply tubing 40 incorporates or is connected to a flow restrictor or other type of expander means (conceptually indicated by reference numeral 50) for creating a pressure drop so as to induce vaporization of a liquid refrigerant, in accordance with well-known refrigeration principles and technology.

In many cases where formation pressure has been depleted to the point that hydrocarbons will no longer flow naturally, water 60 will have accumulated within well 10, and will permeate formation 20. However, to use the present method in depleted wells that are not already water-laden, water 60 is introduced to a desired height within well annulus 16, from which it may flow into cracks and fissures in formation 20 (either directly or through perforations 14).

Next, a suitable liquid and/or gaseous refrigerant 70 (e.g., liquid nitrogen, liquid carbon dioxide, calcium chloride brine, or, preferably, liquid propane) is pumped downward through bore 44 of supply tubing 40. Liquid refrigerant 70 is forced past expander means 50, causing the liquid refrigerant 70 to expand. Because the lower end 32 of return tubing 30 is plugged, the expanded refrigerant 70E is forced upward through tubing annulus 36 to the surface, where it passes through a condenser (not shown) for recirculation into supply tubing 40. In accordance with well-known refrigeration principles, the circulation of refrigerant 70 through supply tubing 40 and return tubing 30, as described above, results in the absorption and removal of heat from water 60 by refrigerant 70, to the point that water 60 freezes. A freezing front propagates radially outward from well 10 into formation 20 as refrigerant 70 continues to circulate and remove more heat, with the result that water within cracks and fissures in formation 20 freezes and expands, causing fracturing of formation 20 as previously described. As mentioned herein, this exemplary freeze-thaw stimulation system and method may be used after the pre-conditioning process has been completed by the shockwave generator.

Figure 4:
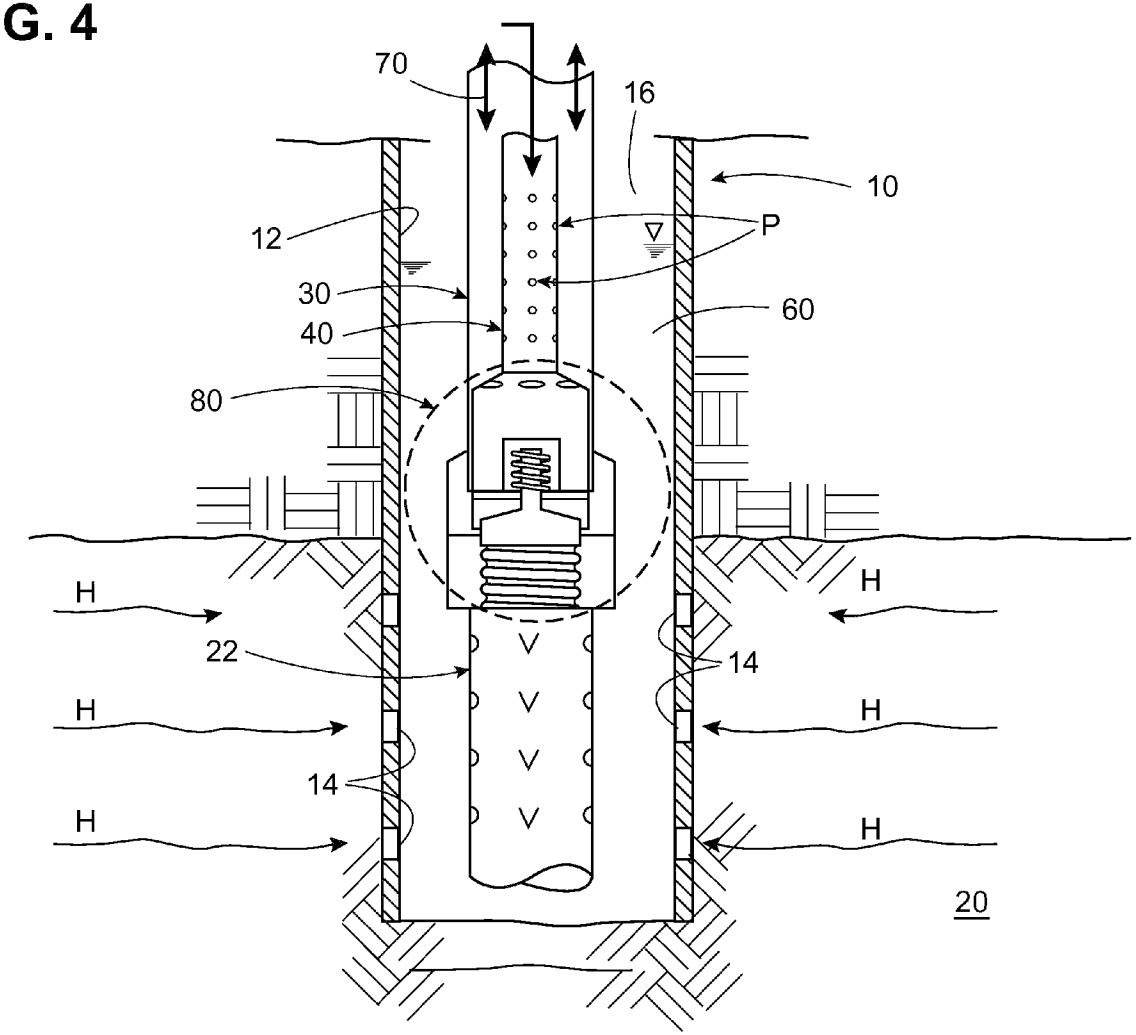
FIG. 4 illustrates a well having a slotted liner with a combination freeze-thaw stimulation device and shockwave generator inserted therein in accordance with an embodiment described herein.
Figure 5B:
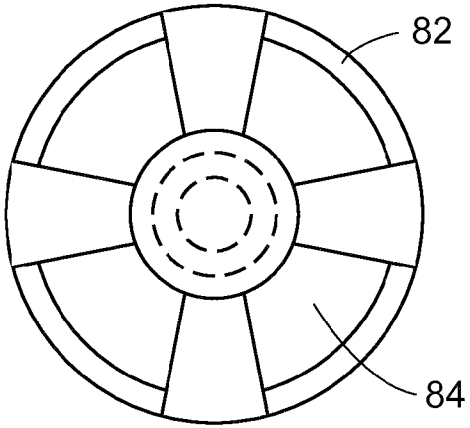
FIGS. 5A and 5D illustrate various views of a pressure valve for use in the embodiment described with respect to FIG. 4.
Figure 5A:
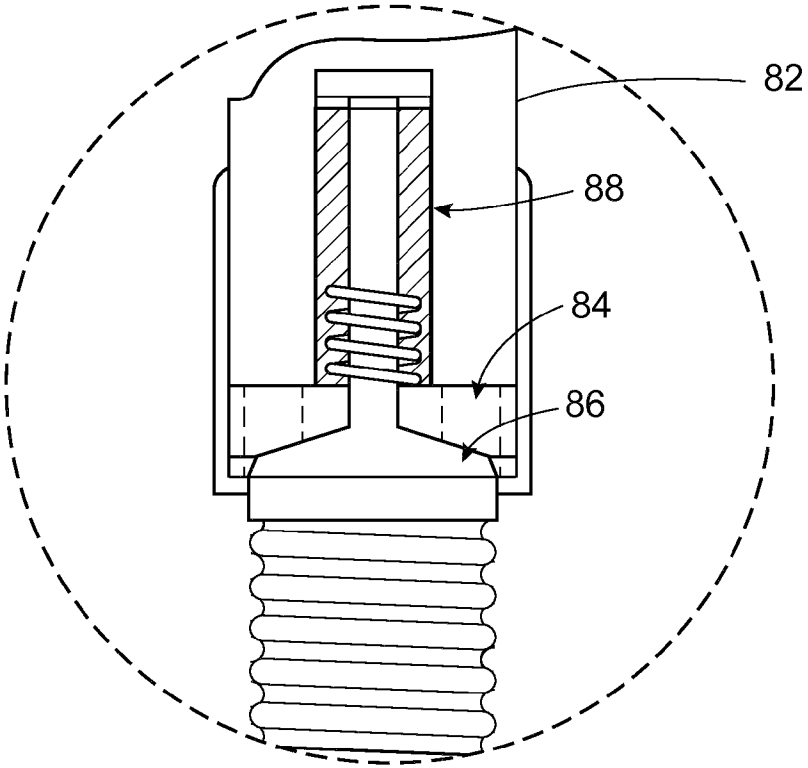

Referring to FIG. 4, a second embodiment of the present invention includes a combination system and resulting method of use which combines the pre-conditioning shockwave generator of FIG. 1 with a freeze-thaw fracturing system similar in function to that of FIG. 3. In the second embodiment, the shockwave generator need not be removed from the well prior to introducing the freeze-thaw stimulation system. Instead, a shockwave generator and freeze-thaw system are combined in a larger system. More particularly, shockwave generator 22 is connected to a freeze-thaw mechanism through a pressure actuated flow control valve 80 (described with reference to FIGS. 5A, 5B). Accordingly, the annular tubing configuration for the freeze-thaw system, e.g., supply tubing 40 and return tubing 30, may be used as a conduit for the heating and/or cooling agent(s) 26 which is passed to the shockwave generator 22 and controlled by the pressure actuated flow control valve 80. Referring to FIGS. 5A, 5B, the control valve 80 includes flow port housing 82, flow ports 84, valve and valve seat 86 and valve spring housing 88.

Further to the specific embodiment of FIG. 4, the combination system can also be controlled to perform the freeze-thaw stimulation described with respect to FIG. 3. In the embodiment of FIG. 4 and in lieu of an expander means 50 shown in FIG. 3, the supply tubing includes perforations P along its length and when operating in the freeze-thaw stimulation mode, pressure actuated flow control valve 80 will be closed since the liquid and/or gaseous refrigerant 70 will only be introduced through the supply tubing 40 and not through both the supply tubing 40 and return tubing 30 and thus would not trigger the pressure actuated flow control valve 80 to open. Instead, the pressure created by dosed valve at the end of the supply tubing 40, will cause the refrigerant 70 to return through the return tubing 30, thus causing the absorption and removal of heat from water 60 by refrigerant 70, to the point that water 60 freezes. A freezing front propagates racially outward from well 10 into formation 20 as refrigerant 70 continues to circulate and remove more heat, with the result that water within cracks and fissures in formation 20 freezes and expands, causing fracturing of formation 20 as previously described.

As will be appreciated by those skilled in the art, the combination system described with respect to FIG. 4 enables a process whereby sections of a well 10 may be successively pre-conditioned by the shockwave generator 22, and then, after repositioning the system, the pre-conditioned section may be subjected to freeze-thaw stimulation. The next section may then be pre-conditioned by the shockwave generator 22, and subsequently stimulated and so on.

It will also be appreciated by those skilled in the art that the shockwave generator and the method of use described herein may be implemented not just as a pre-conditioning, component and method, but as a stand-alone stimulation methodology. Other variations to the exemplary embodiments described herein may be known to those skilled in the art and as such are considered to be within the scope of the embodiments. Additionally, while the orientation of the figures are vertical, it should be understood that the present embodiments are applicable to horizontal, vertical and slanted wells.

The invention claimed is:

1. A system for accessing hydrocarbons in a well bore comprising:

a first subsystem including a shockwave generator for introducing fractures at one or more points on the sides of the well bore, the first subsystem having a first length and first width, wherein the first width is less than a diameter of the well bore, the first subsystem including:

a first valved end;

a hollow core for receiving at least one of a liquid or gas therein via the first valved end;

a second closed end; and a first plurality of exit slots located along a periphery between the first valved end and the second closed end for facilitating exit of the at least one liquid or gas from the first subsystem into the well bore, wherein shockwaves are generated upon exit of the at least one liquid or gas thereby introducing fractures at the one or more points on the sides of the well bore;

a second subsystem for expanding fractures introduced by the first subsystem using freeze-thaw fracturing and thereby releasing hydrocarbons, a second subsystem having a second length and second width, the second width is less than a diameter of the well bore, the second subsystem including:

a first tube having a first diameter, an entrance port, a closed end opposite the entrance port, and a second plurality of exit slots along a periphery thereof;

a second tube having a second diameter, wherein the second diameter is larger than the first diameter and the second tube includes the first tube therein, thereby creating an annulus between the first tube and the second tube, the annulus having a dual flow annulus concentric with the first entrance port of the first tube and an exit annulus concentric with the closed end of the first tube;

a pump for introducing at least one of a fluid or gas to the first or second subsystem and a pressure valve for mechanically and functionally connecting the first subsystem to the second subsystem;

wherein when the at least one of a liquid or gas is simultaneously pumped into both the entrance port and the entrance annulus of the second subsystem, the pressure valve opens and allows the at least one of a liquid or gas to enter the first valved end of the first subsystem, thereby creating shockwaves as the at least one of a liquid or gas exits through the first plurality of exit slots; and further wherein when the at least one of a liquid or gas is pumped into the entrance port of the second subsystem, the at least one of a liquid or gas exits the second plurality of exit slots into the annulus and returns out of the second subsystem through the dual flow annulus.

2. The system of claim 1 further comprising a mechanism mechanically attached to at least one of the first and second subsystems for inserting the connected first and second subsystems into the well bore and for positioning the first subsystem at a production site during a first time and for positioning the second subsystem at the production site during a second time, wherein the second time occurs after the first time.

3. The system of claim 1, wherein the at least one of a fluid or gas is a cooling agent.

4. The system of claim 1, wherein the at least one of a fluid or gas is a heating agent.

5. The system of claim 1, wherein a shape of a cross section of the width of the first subsystem includes at least one angle.

6. The system of claim 1, wherein a shape of a cross section of the first subsystem's width is hexagonal.

7. A system for accessing hydrocarbons in a well bore comprising:

a first subsystem including a shockwave generator for introducing fractures at one or more points on the sides of the well bore, the first subsystem having a first length and first width, wherein the first width is less than a diameter of the well bore, the first subsystem including:

a hollow core for receiving at least one of a liquid or gas therein; and a first plurality of exit slots located along a periphery of the first subsystem, wherein shockwaves are generated upon exit thereof of the at least one liquid or gas thereby introducing fractures at the one or more points on the sides of the well bore;

a second subsystem for expanding fractures introduced by the first subsystem using freeze-thaw fracturing and thereby releasing hydrocarbons, the second subsystem having a second length and second width, wherein the second width is less than a diameter of the well bore, the second subsystem including:

a first tube having a first diameter and a second plurality of exit slots along a periphery thereof;

a second tube having a second diameter, wherein the second diameter is larger than the first diameter and the second tube includes the first tube therein;

a pump for introducing at least one of a fluid or gas to the first or second subsystem and a pressure valve for mechanically and functionally connecting the first subsystem to the second subsystem;

wherein when the at least one of a liquid or gas is simultaneously pumped into both an entrance port and an entrance annulus of the second subsystem, the pressure valve opens and allows the at least one of a liquid or gas to enter the hollow core of the first subsystem, thereby creating shockwaves as the at least one of a liquid or gas exits through the first plurality of exit slots; and further wherein when the at least one of a liquid or gas is pumped into the entrance port of the second subsystem, the at least one of a liquid or gas exits the second plurality of exit slots and returns out of the second subsystem.

8. The system of claim 7, further comprising a mechanism mechanically attached to at least one of the first and second subsystems for inserting the connected first and second subsystems into the well bore and for positioning the first subsystem at a production site during a first time and for positioning the second subsystem at the production site during a second time, wherein the second time occurs after the first time.

9. The system of claim 7, wherein the at least one of a fluid or gas is a cooling agent.

10. The system of claim 7, wherein the at least one of a fluid or gas is a heating agent.

11. The system of claim 7, wherein a shape of a cross section of the first subsystem's width includes at least one angle.

12. The system of claim 7, wherein a shape of a cross section of the first subsystem's width is hexagonal.

* * * * *